US005518226A

United States Patent [19]

Silver et al.

[11] Patent Number: 5,518,226

[45] Date of Patent: May 21, 1996

[54] SPRING SEATING SUPPORT SYSTEM

[75] Inventors: Marty Silver, Memphis, Tenn.; Bruno Policicchio, Tupelo, Miss.

[73] Assignee: Bauhaus USA, Inc., Saltillo, Miss.

[21] Appl. No.: 227,043

[22] Filed: Apr. 13, 1994

[51] Int. Cl.[6] ..... F16F 3/00

[52] U.S. Cl. ..... 267/103; 267/101; 5/267

[58] Field of Search ..... 5/252, 256, 257, 5/259.1, 267, 275, 276, 101; 267/103, 104, 105, 107, 95

[56] References Cited

U.S. PATENT DOCUMENTS

| | | | |
|---|---|---|---|
| 184,568 | 11/1876 | Allen | 5/267 |
| 254,277 | 2/1882 | Colgrove | 5/617 |
| 441,652 | 12/1890 | Foster | 5/267 |
| 540,838 | 6/1895 | Locklin | 5/246 |
| 803,933 | 11/1905 | Smith . | |
| 857,666 | 6/1907 | Phelps | 5/266 |
| 882,600 | 3/1908 | Weborg | 5/252 |
| 1,062,597 | 5/1913 | Lewis | 5/276 |
| 1,155,392 | 10/1915 | Young | 5/252 |
| 1,493,179 | 5/1924 | Young et al. | 5/256 |
| 2,002,157 | 5/1935 | Reed | 155/179 |
| 2,013,573 | 11/1935 | McNally | 155/179 |
| 2,151,155 | 3/1939 | Rymland | 5/259 |
| 2,250,163 | 7/1941 | Krueger | 5/252 |
| 2,378,625 | 6/1945 | Elder | 5/276 |
| 2,540,495 | 2/1951 | Sorenson | 5/267 |
| 2,689,962 | 9/1954 | Hutcheson | 5/351 |
| 2,945,245 | 7/1960 | Gleason | 5/351 |
| 3,084,353 | 4/1968 | Levine | 5/248 |
| 3,983,910 | 10/1976 | Dasher | 140/3 |
| 4,003,563 | 1/1977 | Taylor | 5/259.1 |
| 4,050,738 | 9/1977 | Griffiths | 267/103 |
| 4,699,362 | 10/1987 | Krakauer | 267/91 |
| 5,184,802 | 2/1993 | Galumbeck | 267/103 |
| 5,375,820 | 12/1994 | Adams | 267/103 |

*Primary Examiner*—Robert J. Oberleitner
*Assistant Examiner*—Chris Schwartz

[57] ABSTRACT

A spring seating support system which includes an upper support frame that includes rigid wire grids located between adjacent rows of coil springs. The rigid wire grids are flexibly connected to the top loop of the coil springs located in adjacent rows, and are comprised of latitudinal perimeter wires welded to longitudinal support wires. Latitudinal interior wires welded to the longitudinal support wires may be added for additional strength where the distance between rows of coil springs requires such support.

20 Claims, 2 Drawing Sheets

SPRING SEATING SUPPORT SYSTEM

BACKGROUND OF THE INVENTION

This invention relates in general to improvements in a spring seating support system for upholstered furniture. This invention is particularly well suited for use as a spring seating support system in sofas, loveseats, chairs, and similar furniture. Although the present invention is in no sense limited to upholstered furniture, the herein illustrated forms which the present invention may take are particularly adapted for employment in upholstered furniture. For this reason the objects and advantages hereinafter disclosed will have specific reference to upholstered furniture, but such objects and advantages are intended to extend to other types of construction wherein any one of the desired characteristics of the spring seating support system would be advantageous.

Conventional box springs for upholstered furniture are comprised of a lower wooden or wire support frame and an upper support system. Between the upper support system and the lower wooden or wire support frame there are a plurality of coil springs which are generally helical or cylindrical coil springs. To insure that the axis of each of the coil springs remains vertical, each spring must be secured to both the upper support system and to the lower wood or wire support frame.

Coil springs are typically aligned in successive rows in such a fashion that the coil springs are substantially aligned with corresponding coil springs in the adjacent row. Thus, the coil springs are aligned in spaced columns and rows. Presently, there is no standard in the industry regarding the spacing of the coil springs in the rows or columns.

The application of weight or pressure to the tops of the coil springs tends to displace the axis of the coil springs out of the vertical position with the result that the springs do not support the weight or pressure evenly. It has generally been difficult to form an upper support system that engages the top loops of the coil springs which is not labor intensive, is durable, reduces compression noise, enhances resiliency, adequately maintains the springs in a vertical alignment, and evenly distributes the support offered by the coil springs.

The prior art discloses a variety of upper support systems. For example, U.S. Pat. No. 3,983,910 discloses a construction wherein a plurality of specially shaped wires are used to connect the coil springs. When the support system and the coil springs are assembled, each of the support wires must essentially be woven between the coil springs. Thus, assembly time and costs are increased. Further, the support system created by these specially shaped wires is not durable due to the constant flexing of the wires, and the nature of the connection of the support wires to the coil springs generates noise during use.

U.S. Pat. No. 4,699,362 employs a support system similar to U.S. Pat. No. 3,983,910. It employs a system of bent pairs of longitudinal and latitudinal wires around the tops of the coil springs. This system also has disadvantages similar to U.S. Pat. No. 3,983,910.

U.S. Pat. No. 2,013,573 employs a connecting strip in the form of burlap or other fabric placed between the rows of coil springs and connected to the coil springs by rings. The disadvantage of this construction is that the burlap or fabric connecting strip is prone to tear or split with use and the rubbing of the ring and the coil spring during compression creates a compression noise.

U.S. Pat. No. 2,378,625 discloses a system of sheet metal strips extending over each coil spring with the sheet metal strips being held in place by a series of tension springs. The constant flexing of the tension springs eventually causes the tension springs to break due to fatigue, and the connection of the tension springs to the metal strips is a source of compression noise.

U.S. Pat. No. 2,689,962 discloses a clamp fashioned in the shape of the letter "X" and made from flat metal, plastic, or other material which is clipped to four separate coil springs. Such a support system does not provide a sufficiently complete surface to prevent the intrusion of padding into the coil springs and to prevent the uneven distribution of padding.

The spring seating support system which is the subject of this invention has been found to be particularly strong, quiet, provides a flatter surface for the padding to lie on, and deters the coil springs from becoming displaced. It employs a rigid wire grid as a method for connecting coil springs by connecting the top loop of the coil springs to the rigid wire grid. The rigid wire grid secures the top loop of the coil spring to insure that the axis of each coil spring remains vertical, to protect the coil springs from the infiltration of the padding, and to connect the coil springs in a manner to distribute the load. Also, the rigid wire grid is pre-fabricated, thus, reducing labor costs, and increasing durability.

SUMMARY OF THE INVENTION

The present invention achieves its objectives by the installation of rigid wire grids between the rows of the coil springs, said grids being secured to the coil springs by clips insulated to reduce noise generation during compression.

Rigid wire grids are placed between the rows of the coil springs. Each rigid wire grid is composed of two parallel latitudinal perimeter wires, a series of longitudinal perpendicular support wires, one or more parallel latitudinal interior wires, a series of insulated clips, and a series of connections, preferably welded connections.

The perimeter of each rigid wire grid is composed of two latitudinal wires. Each of the latitudinal perimeter wires is attached to a row of coil springs by insulated clips. The latitudinal wires do not extend to the heavy gauge border wire of the spring system, falling just short of contacting the wire frame.

A series of generally parallel longitudinal wires connect the two latitudinal perimeter wires which form the perimeter of each rigid wire grid. The series of generally parallel longitudinal wires are preferably perpendicular to the two latitudinal perimeter wires. A longitudinal wire is placed at each end of the two latitudinal perimeter wires, and at spaced intervals along the latitudinal perimeter wires. Generally, a longitudinal wire is placed in line with the space between each column of coil springs. The ends of these generally parallel longitudinal wires are connected, preferably by welding, to the underside of the two latitudinal perimeter wires.

One or more latitudinal interior wires are placed generally perpendicular to the longitudinal wires and generally parallel to the two latitudinal perimeter wires. The latitudinal interior wires are connected, preferably by welding, to the perpendicular longitudinal wires. The ends of the latitudinal interior wires do not extend to the heavy gauge border wire of the spring system, falling just short of contacting the wire frame.

A heavy gauge border wire extends continuously around the periphery of the exterior coil springs, generally in the same plane as the top surfaces of the coil springs, to define the planar surface of the spring assembly. The border wire is secured to the exterior coil springs by insulated clips.

No wires extend over the tops of any of the coil springs. The rigid wire grids are placed between the rows of the coil springs. The number of rigid wire grids depends upon the number of rows of coil springs.

The advantages of this spring seating support system comprising one or more rigid wire grids are substantial. Assuming a downward force applied on the rigid wire grid between two rows of coil springs, the tops of the coil springs in the rows will be lowered and forces will attempt to bend the coil springs towards the focus of the downward force. However, the rigid wire grids will not allow the coil springs to leave their vertical axis. Thus, the coil springs are allowed to flex freely up and down, but are not displaced from their vertical axis. The rigid wire grid also distributes the downward force among the several coil springs.

It is an object of this invention to provide a spring seating support system in which the individual coil springs are interconnected in a novel and improved manner which deters displacement of the coil springs from their vertical axes.

It is still another object of this invention to distribute the load across the coil springs.

It is yet another object of this invention to provide a rigid wire grid support system in which the wire grid is durable and sturdy.

It is yet another object of this invention to provide a rigid wire grid support system which reduces compression noise.

It is yet another object of this invention to provide a rigid wire grid support system in which the wire grid provides a relatively flat surface on which the padding can be placed in order to minimize or reduce uneven distribution of padding.

It is yet another object of this invention to provide a rigid wire grid support system in which the wire grid blocks penetration or infiltration of padding into the area occupied by the coil springs.

It is yet another object of this invention to provide a rigid wire grid support system, the production of which is not labor intensive.

These and other objects of the present invention will be more apparent to those skilled in the art from the following detailed description of the invention.

BRIEF DESCRIPTION OF THE DRAWING

Reference will be made to the drawing wherein like parts are designated by like numerals and wherein.

DETAILED DESCRIPTION OF THE PREFERRED EMBODIMENT

Figure 1:
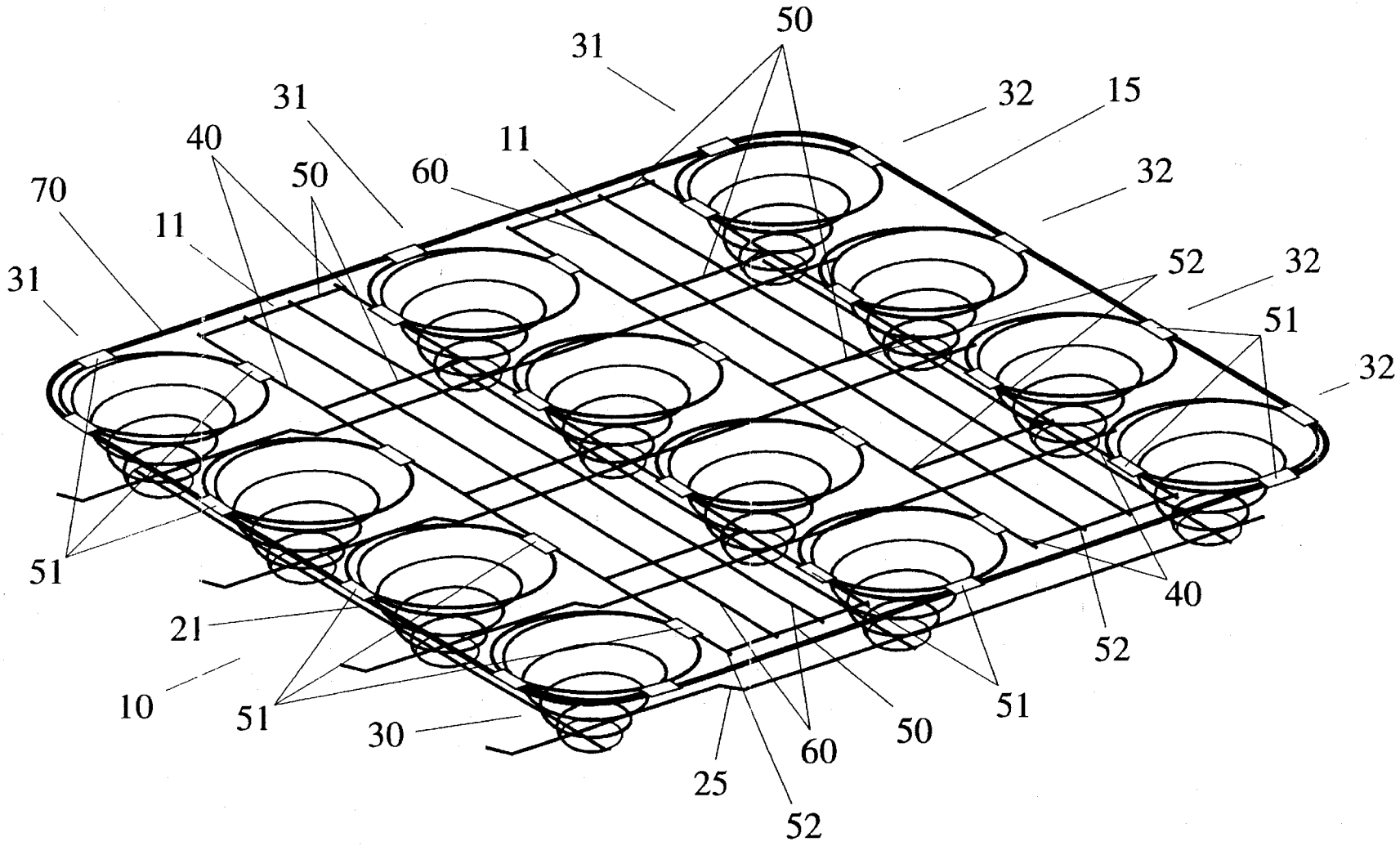
FIG. 1 is a perspective view of the spring seating support system.

Referring now to the drawings in more detail, the preferred embodiment of the spring seating support system is generally designated by the numeral 10.

The spring seating support system 10 is comprised of an upper support frame 15 and lower support frame 21 located in generally parallel planes spaced apart by a plurality of coil springs 30. The upper support frame 15 is comprised of one or more rigid wire grids 11, and a heavy gauge border wire 70. Each rigid wire grid 11 is comprised of five main components, specifically two parallel latitudinal perimeter wires 40, a plurality of longitudinal perpendicular support wires 50, one or more latitudinal interior wires 60, a plurality of insulated clips 51, and a plurality of connections 52.

A plurality of coil springs 30 are spaced in a series of latitudinal rows 31. The coil springs 30 in each latitudinal row 31 may, but generally do not, touch each other. A space of from ¼th to three inches, and preferably approximately one inch separates the coil springs 30 in each latitudinal row 31. The coil springs 30 form two or more latitudinal rows 31. A typical seat arrangement will have three latitudinal rows 31 of coil springs 30. The latitudinal rows 31 of the coil springs 30 do not touch each other. A space of from two to ten inches, and preferably approximately four inches, separates the latitudinal rows 31 from each other. Each coil spring 30 is mounted to the lower support frame 21 at the bottom of each coil spring 30.

Figure 2:
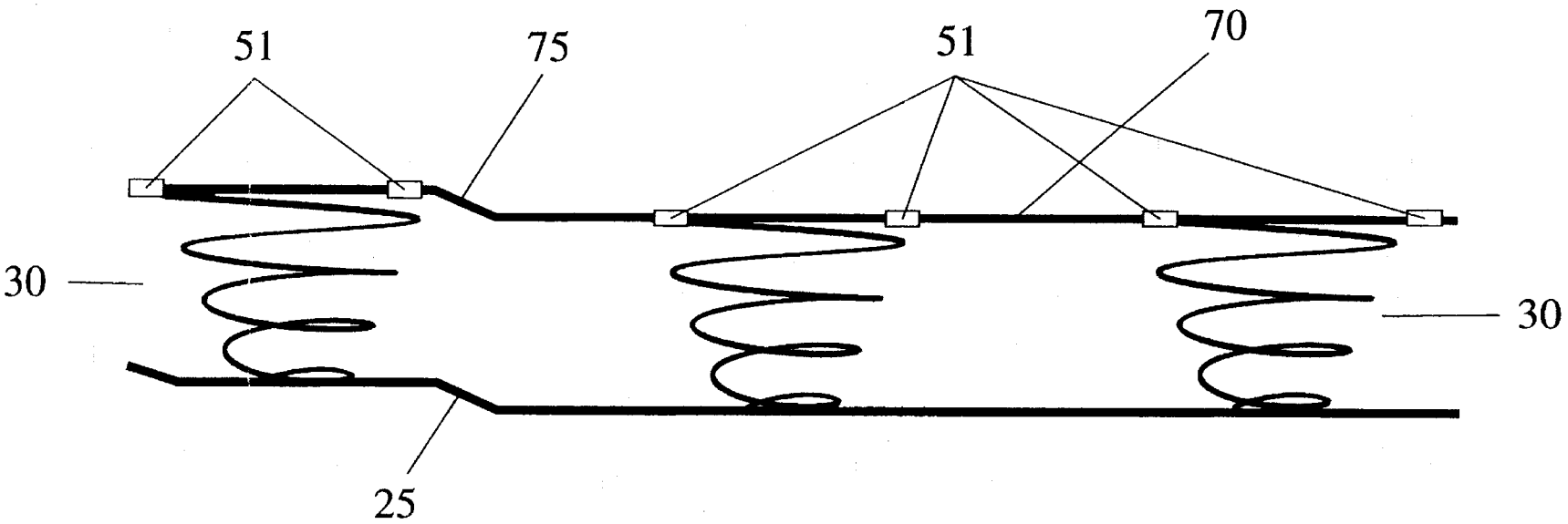
FIG. 2 is a partial side view of the spring seating support system.

Each coil spring 30 on the exterior of the spring seating support system 10 is attached to a heavy gauge border wire 70 by an insulated clip 51. The insulated clip 51 securely fastens the coil springs 30 to the heavy gauge border wire 70. The insulated clip 51 is insulated such that when the coil springs 30 are compressed during use there will be no compression noise caused by the connection between the exterior coil springs 30 and the heavy gauge border wire 70. The heavy gauge border wire 70 may be bent upwards at one end of the spring seating support system 10. As best seen in FIG. 2, the border wire 70 in the upper support frame 15 may have an upward bend 75, Such an upward bend 75 may be oriented at that portion of the spring seating support system 10 which will be located at the front of the item of furniture, under the area occupied by the knees of the user of the furniture. The lower support frame 21 may also be bent upwards at the corresponding location 25 of the spring seating support system 10. This tends to prevent the coil springs 30 from being pushed forward during use, and gives greater resistance to the front of the spring seating support system 10.

The number of rigid wire grids 11 in each spring seating support system 10 is determined by the number of latitudinal rows 31 of coil springs 30. A rigid wire grid 11 is placed between adjacent latitudinal rows 31 of coil springs 30. In FIG. 1 there are three latitudinal rows 31 of coil springs 30, requiring two rigid wire grids 11. In a typical seating arrangement the rigid wire grid 11 between the second and third latitudinal rows 31 of coil springs 30 supports the majority of the weight of the user of the spring seating support system 10.

Parallel latitudinal perimeter wires 40 are connected to each latitudinal row 31 of coil springs 30 along that portion of the coil springs 30 that is closest to the space between latitudinal rows 31 of coil springs 30. Latitudinal rows 31 of coil springs 30 along the exterior of the spring seating support system 10 will be connected to one latitudinal perimeter wire 40. Latitudinal rows 31 of coil springs 30 in the interior of the spring seating support system 10 will be connected to two latitudinal perimeter wires 40 (with each latitudinal perimeter wire 40 being part of a separate rigid wire grid 11). Two parallel latitudinal wires 40 on either side of the space between two adjacent rows of coil springs 30 form the perimeter of a rigid wire grid 11.

The length of the parallel latitudinal perimeter wires 40 of a rigid wire grid 11 is dependent upon the length of the latitudinal rows 31 of coil springs 30. The parallel latitudinal perimeter wires 40 do not extend to the heavy gauge border wire 70. The parallel latitudinal perimeter wires 40 extend to a point just short of contacting the heavy gauge border wire 70. This length enables the rigid wire grid 11 to float between the coil springs 30. As a result, the rigid wire grid 11 is better able to evenly distribute any applied weight among the coil springs 30.

The parallel latitudinal perimeter wires 40 are secured to the coil springs 30 by insulated clips 51. The insulated clip ,51 is insulated so that when the coil springs 30 are compressed during use there will be no compression noise caused by the connection between latitudinal perimeter wires 40 and coil springs 30. The latitudinal perimeter wire 40 is connected to the uppermost loop of each coil spring 30. The latitudinal perimeter wire may be connected to the top side of the uppermost loop of the coil spring 30, along the side of the uppermost loop of the coil spring 30, or on the underside of the uppermost loop of the coil spring 30. Preferably the latitudinal perimeter wire 40 is connected to the coil spring 30 in the same manner as the heavy gauge border wire 70.is connected to the coil spring 30, to place both the perimeter wires 40 and border wire 70 in the same plane. The most preferred method is to connect the latitudinal perimeter wires 40 and the heavy gauge border wire 70 to the topside of the uppermost loop of the coil springs 30.

A plurality of generally parallel longitudinal support wires 50 connect two adjacent parallel latitudinal perimeter wires 40. The longitudinal support wires 50 may be placed at any number of angles relative to the latitudinal perimeter wires 40, but are preferably placed at right angles to the parallel latitudinal perimeter wires 40, whereby the plurality of generally parallel longitudinal wires 50 are perpendicular to the parallel latitudinal perimeter wires 40.

Longitudinal support wires 50 are located at the ends of adjacent parallel latitudinal perimeter wires 40. Additional longitudinal support wires 50 are placed at intervals across the two adjacent parallel latitudinal perimeter wires 40. Preferably there is a longitudinal support wire 50 placed across the parallel latitudinal perimeter wires 40 in a manner aligning with the space between each longitudinal column 32 of coil springs 30. Additional longitudinal support wires 50 may be added if desired. In FIG. 1, there are four coil springs 30 in each latitudinal row 31, thereby forming four longitudinal columns 32 of coil springs 30, with five longitudinal support wires 50 connecting the two parallel latitudinal perimeter wires 40. More or fewer longitudinal support wires 50 may be employed, with various spacing, depending upon the degree of rigidity desired, and the required support and durability.

The longitudinal support wires 50 are rigidly connected to the two adjacent parallel latitudinal perimeter wires 40. A variety of connecting methods may be employed, but the preferable method is a welded connection 52. The longitudinal support wires 50 may be placed above or below the latitudinal perimeter wires 40, but are preferably placed below. By welding the longitudinal support wires 50 to the bottom of the latitudinal perimeter wires 40 the longitudinal support wire 50 will fall to the bottom of the spring seating support system 10, and not be thrust up into the padding of the seat, if the welded connections 52 become broken. The welded connection 52 between the longitudinal support wires 50 and the latitudinal perimeter wires 40 is superior to a flexible connection between the two wires. The welded connection 52 is more durable than a flexible connection, and the welded connection 52 does not generate a compression noise that a flexible connection generates.

One or more latitudinal interior wires 60 may be placed generally perpendicular to the longitudinal support wires 50 and parallel to the latitudinal perimeter wires 40. FIG. 1 illustrates two parallel latitudinal interior wires 60 in each rigid wire grid 11. It is not necessary that the rigid wire grid 11 have any latitudinal interior wires 60 if the space between the two latitudinal perimeter wires 40 is narrow enough for the longitudinal support wires 50 to traverse the space without the need for additional support. The latitudinal interior wires 60 are preferably evenly spaced between the parallel latitudinal perimeter wires 40. The latitudinal interior wires 60 are connected to the longitudinal support wires 50. A variety of connecting methods may be employed, but the preferable method is a welded connection 52. The latitudinal interior wires 60 may be placed above or below the longitudinal support wires 50, but are preferably placed above. By welding the latitudinal interior wires: 60 to the top side of the longitudinal support wires 50 the longitudinal support wire 50 is allowed to fall to the bottom of the spring seating support system 10, and not be thrust up into the padding of the seat, if the welded connections 52 become broken. Additionally, placing the latitudinal interior wires 60 above the longitudinal wires 50 provides a more uniform upper surface for application of cushioning material. The welded connection 52 between the longitudinal support wires 50 and the latitudinal interior wires 60 is superior to a flexible connection between the two wires. The welded connection 52 is more durable than a flexible connection, and the welded connection does not generate a compression noise that a flexible connection generates.

The latitudinal interior wires 60 extend to a point just short of contacting the heavy gauge border wire 70. This length enables the rigid wire grid 11 to float between the coil springs 30. As a result, the rigid wire grid 11 is better able to evenly distribute any applied weight among the coil springs 30.

The spring seating support system 10 may be fastened to the frame of a piece of furniture by fastening the bottom of each coil spring 30 to the furniture frame foundation. In this manner movement of the bottom of the coil spring 30 is prevented, reducing noise generation during use of the furniture. The bottom of the coil spring 30 in the front row of coil springs 30 may be fastened to the front rail of the piece of furniture, and this front rail may be elevated above the furniture frame foundation to which the other rows of coil springs 30 are fastened, in cases where the front of the spring seating support system 10 is bent upwards. This increased height at the front of the spring seating support system 10 creates a pitch toward the rear of the piece of furniture, and provides greater resistance at the front of the piece of furniture.

What we claim is:

1. A spring seating support system comprising;

a lower support frame and an upper support frame, said lower support frame and said upper support frame being located in parallel planes, a plurality of springs located between and in contact with said lower support frame and said upper support frame, said plurality of springs being arranged in a plurality of rows, said rows of springs defining a space between each adjacent pair of said rows, said springs having their axes oriented perpendicularly to the parallel planes in which said lower and upper support flames are located, said upper support frame further comprising, at least one rigid wire grid located in said spaces between each adjacent pair of said rows of said springs, said at least one rigid wire grid further comprising, two parallel latitudinal perimeter wires, one each being located at each edge of said space between the adjacent pair of said rows of said springs, means to flexibly connect each of said two parallel latitudinal perimeter wires to each of said springs forming said row of said springs adjacent said two parallel latitudinal perimeter wires, a plurality of longitudinal support wires traversing said space between the adjacent pair of said rows of said springs, and means to rigidly connect said plurality of longitudinal support wires to said two parallel latitudinal perimeter wires, wherein said plurality of longitudinal support wires do not contact any of said springs, and do not extend beyond said latitudinal perimeter wires.

2. A spring seating support system as in claim 1 wherein said at least one rigid wire grid further comprises at least one latitudinal interior wire located between said two parallel latitudinal perimeter wires, and means to rigidly connect said at least one latitudinal interior wire to said plurality of longitudinal support wires.

3. A spring seating support system as in claim 2 wherein said means to rigidly connect said at least one latitudinal interior wire to said plurality of longitudinal support wires is by welding said wires together.

4. A spring seating support system as in claim 1 wherein said means to rigidly connect said plurality of longitudinal support wires to said two parallel latitudinal perimeter wires is by welding said wires together.

5. A spring seating support system as in claim 1 wherein said means to flexibly connect each of said two parallel latitudinal perimeter wires to each of said springs forming said row of said springs adjacent said two parallel latitudinal perimeter wires is by the use of clips.

6. A spring seating support system as in claim 5 wherein said clips are insulated to reduce the noise created when the clipped connection is flexed.

7. A spring seating support system as in claim 1 wherein said upper support frame further comprises, a border wire placed completely around the periphery of said plurality of springs at the uppermost portion of said springs, and means to flexibly connect said border wire to each of said springs located on the periphery of said plurality of springs.

8. A spring seating support system as in claim 6 wherein said two parallel latitudinal perimeter wires extend the entire length of said space between each adjacent pair of said rows, from a point just adjacent said border wire at one end of said two parallel latitudinal perimeter wires to a point just adjacent said border wire at the other end of said two parallel latitudinal perimeter wires, said two parallel latitudinal perimeter wires not contacting said border wire.

9. A spring seating support system as in claim 1 wherein said springs are coil springs.

10. A spring seating support system as in claim 1 wherein said space between each adjacent pair of said rows is in the range of from two to ten inches wide.

11. A spring seating support system as in claim 1 wherein said space between each adjacent pair of said rows is approximately four inches wide.

12. A spring seating support system as in claim 1 wherein said springs being arranged in a plurality of rows are further arranged such that the springs in a single row of springs are separated from each other by a space ranging from ¼th inch to three inches wide.

13. A spring seating support system as in claim 1 wherein said springs being arranged in a plurality of rows are further arranged such that the springs in a single row of springs are separated from each other by a space approximately 1 inch wide.

14. A spring seating support system as in claim 1 wherein said plurality of longitudinal support wires are perpendicular to said two parallel latitudinal perimeter wires.

15. A spring seating support system as in claim 1 wherein said plurality of longitudinal support wires include longitudinal support wires connecting each pair of adjacent ends of said two parallel latitudinal perimeter wires.

16. A spring seating support system as in claim 1 wherein said plurality of longitudinal support wires are connected to the underside of said two parallel latitudinal perimeter wires.

17. A spring seating support system comprising;

a lower support frame and an upper support frame, said lower support frame and said upper support frame being located in parallel planes, a plurality of springs located between and in contact with said lower support frame and said upper support frame, said plurality of springs being arranged in three rows, said three rows of springs defining two spaces, one each of said spaces being located between each adjacent pair of said rows, said springs having their axes oriented perpendicularly to the parallel planes in which said lower and upper support frames are located, said upper support frame further comprising, two rigid wire grids, one each of said two rigid wire grids being located in each of said two spaces, a border wire placed completely around the periphery of said plurality of springs at the uppermost portion of said springs, means to flexibly connect said border wire to each of said springs located on the periphery of said plurality of springs, said two rigid wire grids each further comprising, two parallel latitudinal perimeter wires, one each being located at each edge of said space between each adjacent pair of said three rows of said springs, insulated clips flexibly connecting each of said two parallel latitudinal perimeter wires to each of said springs forming said row of said springs adjacent said two parallel latitudinal perimeter wires, a plurality of longitudinal support wires traversing said space defined by said adjacent pair of rows of said springs, said longitudinal support wires being rigidly connected to said two parallel latitudinal perimeter wires by welding, wherein said plurality of longitudinal support wires do not contact any of said springs, and at least one latitudinal interior wire located between said two parallel latitudinal perimeter wires, said at least one latitudinal interior wire being rigidly connected to said plurality of longitudinal support wires by welding.

18. A spring seating support system as in claim 17 wherein said two parallel latitudinal perimeter wires and said at least one latitudinal interior wire extend the entire length of said space between each adjacent pair of said three rows, from a point just adjacent said border wire at one end of said two parallel latitudinal perimeter wires and at one end of said at least one latitudinal interior wire to a point just adjacent said border wire at the other end of said two parallel latitudinal perimeter wires and at the other end of said at least one latitudinal interior wire, said two parallel latitudinal perimeter wires and said at least one latitudinal interior wire not contacting said border wire.

19. A spring seating support system as in claim 17 wherein said plurality of longitudinal support wires are connected to the underside of said two parallel latitudinal perimeter wires.

20. A spring seating support system comprising;

a lower support frame and an upper support frame, said lower support frame and said upper support frame being located in parallel planes, with said lower support frame and said upper support frame further being bent upwards adjacent one end of said spring seating support system, a plurality of springs located between and in contact with said lower support frame and said upper support frame, said plurality of springs being arranged in three rows, said three rows of springs defining two spaces, one each of said spaces being located between each adjacent pair of said rows, said springs having their axes oriented perpendicularly to the parallel planes in which said lower and upper support frames are located, said upper support frame further comprising, two rigid wire grids, one each of said two rigid wire grids being located in each of said two spaces, a border wire placed completely around the periphery of said plurality of springs at the uppermost portion of said springs, means to flexibly connect said border wire to each of said springs located on the periphery of said plurality of springs, said two rigid wire grids each further comprising, two parallel latitudinal perimeter wires, one each being located at each edge of said space between each adjacent pair of said three rows of said springs, insulated clips flexibly connecting each of said two parallel latitudinal perimeter wires to each of said springs forming said row of said springs adjacent said two parallel latitudinal perimeter wires, a plurality of longitudinal support wires traversing said space defined by said adjacent pair of rows of said springs, said longitudinal support wires being rigidly connected to said two parallel latitudinal perimeter wires by welding, wherein said plurality of longitudinal support wires do not contact any of said springs, and at least one latitudinal interior wire located between said two parallel latitudinal perimeter wires, said latitudinal interior wire being rigidly connected to said plurality of longitudinal support wires by welding.

* * * * *